US005329055A

United States Patent [19]

Bachman et al.

[11] Patent Number: 5,329,055

[45] Date of Patent: * Jul. 12, 1994

[54] METHOD OF SUPPRESSING MIST FORMATION FROM OIL-CONTAINING FUNCTIONAL FLUIDS

[75] Inventors: Harold E. Bachman, Summit; Chung K. Shih, Scotch Plains, both of N.J.

[73] Assignee: Exxon Chemical Patents Inc., Linden, N.J.

[ * ] Notice: The portion of the term of this patent subsequent to Jul. 13, 2010 has been disclaimed.

[21] Appl. No.: 61,899

[22] Filed: May 14, 1993

Related U.S. Application Data

[62] Division of Ser. No. 717,433, Jun. 19, 1991, Pat. No. 5,227,551.

[51] Int. Cl.[5] ..... C10M 143/06

[52] U.S. Cl. ..... 585/12; 585/10

[58] Field of Search ..... 585/10, 12

[56] References Cited

U.S. PATENT DOCUMENTS

| | | | |
|---|---|---|---|
| 2,534,095 | 12/1950 | Young | 585/12 |
| 3,093,624 | 6/1963 | Gresham et al. | 585/12 |
| 3,477,957 | 11/1969 | Hall | 585/12 |
| 3,805,918 | 4/1974 | Altgelt | 184/1 E |
| 3,855,135 | 12/1974 | Newingham | 585/12 |
| 3,919,098 | 11/1975 | Altgelt | 252/59 |
| 3,929,652 | 12/1975 | Seni et al. | 252/46.7 |
| 4,105,569 | 8/1978 | Crossfield | 252/8.6 |
| 4,173,455 | 11/1979 | Fodor et al. | 44/51 |
| 4,210,544 | 7/1980 | Burton et al. | 252/47.5 |
| 4,384,089 | 5/1983 | Dehm | 526/159 |
| 4,400,281 | 8/1983 | Dehm | 252/8.6 |
| 4,527,581 | 7/1985 | Motier | 137/252 |
| 4,589,990 | 5/1986 | Zehler et al. | 252/56 S |
| 4,601,840 | 7/1986 | Zehler et al. | 585/12 |
| 4,740,324 | 4/1988 | Schur | 252/56 R |

FOREIGN PATENT DOCUMENTS

| | | | |
|---|---|---|---|
| 1525599 | 9/1978 | United Kingdom | C10M 1/18 |

*Primary Examiner*—Jacqueline V. Howard
*Attorney, Agent, or Firm*—J. W. Ditsler; D. S. Lader

[57] ABSTRACT

There is disclosed a method of suppressing misting or spatting from an oil-containing functional fluid, such as a chain saw lubricant, by blending with the functional fluid a mist suppressing effective amount of a copolymer of a $C_3$ or $C_4$ alpha-monoolefin and at least one other alpha-monoolefin having from 5 to about 20 carbon atoms, said copolymer having a viscosity average molecular weight of from about 500,000 to about 10 million.

20 Claims, No Drawings

METHOD OF SUPPRESSING MIST FORMATION FROM OIL-CONTAINING FUNCTIONAL FLUIDS

This is a division of application Ser. No. 07/717,433 filed Jun. 19, 1991 now U.S. Pat. No. 5,227,551.

BACKGROUND OF THE INVENTION 1. Field of the Invention

This invention relates to a method of suppressing mist from oil-containing functional fluids suitable for single use applications, such as, for example, rock drill oils, agricultural spray oils, chain saw oils, ammonium nitrate fuel oil blasting agents, sheet metal drawing lubricants and the like. More particularly, this invention relates to the addition to single use oil-containing functional fluids, such as chain saw lubricating oil compositions, of a mist suppressing amount of a high molecular weight copolymer prepared from alpha-monoolefins having 3 to about 20 carbon atoms.

2. Prior Art

Oil-containing compositions used as lubricants for chain saws generally comprise a lubricating oil component and a tackifier component which is intended to prevent the compositions from misting or spattering off the end of the chain during use. Known chain saw lubricating compositions, as disclosed, for example, in U.S. Pat. No. 4,740,324, include such tackifying components as polyethylene glycol or polyacrylic amide, each having a molecular weight of 1 million or above, or colophonium-containing resins such as balsam resin obtained from terpentine balsam, root resin obtained by solvent extraction from root stocks, and tall resin obtained by fractional distillation of tall oil.

The use of an anti-mist additive in various other lubricating oil compositions has also been described. For example, U.S. Pat. Nos. 3,929,652 and 4,210,544 relate to dual purpose cutting oils which serve as heavy duty cutting oils and machine lubricants and which comprise a base oil, an extreme pressure agent, a copper corrosion inhibitor and, preferably, a copolymer of ethylene and propylene as an anti-mist additive. Particularly preferred copolymer anti-mist additives are described as having a molecular weight ranging from about 70,000 to about 100,000 and a propylene content of from about 35 to about 50 percent.

British Patent 1,525,599 discloses a metal working lubricating oil composition which contains a major amount of an oil of lubricating viscosity, and a minor amount, sufficient to inhibit the composition from misting while in use, of at least one oil-soluble ethylene copolymer having a viscosity average molecular weight in the range from 130,000 to 250,000. The ethylene copolymer is derived from the copolymerization of ethylene and a heavier olefin selected from terminally unsaturated straight chain monoolefins containing from 3 to 12 carbon atoms, alpha-phenyl-1-alkenes containing 9 or 10 carbon atoms, 2-norbornene, terminally unsaturated non-conjugated di-olefins containing from 5 to 8 carbon atoms, dicyclopentadiene, 5-methylene-2-norbornene, and mixtures thereof. Preferably, the heavier olefin is propylene and the mole ratio of ethylene to the heavier olefin in the copolymer is in the range of from 1:3 to 3:1.

U.S. Pat. No. 3,919,098 relates to metal working compositions having improved low fog properties. The disclosed compositions comprise a major amount of a hydrocarbon oil and a minor amount of an antifog additive selected from polyisobutylene, poly-n-butene and mixtures thereof. The antifog additive is said to have a viscosity average molecular weight of from 0.3 to 10 million.

U.S. Pat. No. 3,805,918 relates to mist oil lubricating systems which pneumatically distribute fine droplets of an oil composition to the areas of various machine elements to be lubricated. The oil compositions described in this patent include a small amount of specified polyolefins to reduce the amount of stray mist during the lubrication process. The polyolefins which are disclosed are $C_2C_x$ copolymers of ethylene having a viscosity average molecular weight greater than 5,000. The polyolefins contain 40–80 molar percent ethylene, and the units defined as $C_x$ are derived from a $C_3$–$C_{12}$ monoolefin. The preferred polyolefins are ethylene-propylene copolymers.

U.S. Pat. No. 4,105,569 relates to yarn finishes, particularly of the coning oil type, which comprise a viscosity index improper such as a polymethacrylate, a polyalkylstyrene, an ethylene-propylene copolymer or a polyisobutylene. The viscosity index improver provides better adherence of the finish to the yarn being treated, less propensity for dripping, and less finish "throw-off" during high speed winding of the treated yarn. The yarn finish formulations also contain a polysiloxane which functions to reduce surface tension of the finish and to prevent mist formation during high speed winding.

U.S. Pat. No. 4,400,281 relates to improving the adhesive and cohesive properties of a textile lubricating composition which contains mineral oil, fatty esters or natural oils and an emulsifying agent by adding to the textile lubricating composition 0.01–10 wt. % of a polymer having a molecular weight of 1–10 million and comprising either homopolymer of normal $C_6$–$C_4$ alpha-monoolefins or copolymers of two or more normal $C_4$–$C_{20}$ alpha-moolefins. Among the copolymers that may be added to the textile lubricating composition are copolymers of butene-1 and at least one $C_5$–$C_{14}$ alpha-monoolefin such as hexene-1, octene-1, decene-1, dodecene-1 and/or tetradecene-1. The addition of the polymer improves the adherency of the lubricating composition without reducing its lubricity and reduces the tendency for the composition to sling.

U.S. Pat. No. 4,173,455 relates to aqueous diesel fuel emulsions which contain diesel fuel, a specified emulsifier, an antimisting agent, and water. The antimisting agent is added to the fuel emulsion to prevent the emulsion from atomizing on impact when a fuel container is ruptured. The antimist agent is supposed to cause the fuel emulsion to be expelled from the ruptured fuel container in "sheets" and "strings of beads" which do not provide sufficient surface area for explosive combustion. The antimisting agents to be used in the diesel fuel emulsion are described as longchain, high molecular weight polymers which were developed to improve flow of oil through pipelines. At column 3, lines 32–35 of this patent, it is stated that the antimisting agents that were used by the patentee were proprietary compositions purchased under the trade name of CDR or AM-1 (from Continental Oil Company) and that the composition of the antimisting agents was unknown. While the exact identity of the CDR or AM-1 polymer compositions is unknown to the applicants herein, it is believed that the compositions comprise homopolymers of octene-1.

U.S. Pat. Nos. 4,384,089 and 4,527,581 relate to the reduction of friction loss normally occurring in hydrocarbon carrying conduits during the transportation of hydrocarbon liquids can be reduced by adding small amounts of certain copolymers to the hydrocarbon liquids. The copolymers are described in U.S. Pat. No. 4,384,089 as comprising copolymers of two or more alpha-monoolefins having 3 to 20 carbon atoms, and in U.S. Pat. No. 4,527,581 as comprising copolymers of butene-1 and another alpha-monolefin having 5 to 20 carbon atoms. Neither of these patents suggests using the copolymers as anything other than hydrocarbon oil pipeline friction reducing agents.

SUMMARY OF THE INVENTION

It is an object of the present invention to provide a method for imparting elasticity or resilience to an oil-containing functional fluid undergoing shear, centrifugal or gravity-induced forces which tend to cause of the fluid to separate either from itself or from the surfaces on which it has been applied.

It is another object to increase the cohesive and adhesive strength of an oil-containing functional fluid by the addition thereto of a high molecular weight alpha-olefin copolymer tackifier additive.

Yet another object is to provide an oil-containing functional fluid which is suitable for single use applications, such as for lubricating chain saw bar and links, wherein the functional fluid is inhibited from misting or spattering by the addition thereto of a mist suppressing amount of a copolymer prepared from at least two alpha-monoolefins containing from 3 to about 20 carbon atoms and having a viscosity average molecular weight of from about 500,000 to 10 million.

It is still another object of the present invention to provide lubricating oil compositions, such as chain saw lubricating oil compositions, which contain a mist suppressing amount of a copolymer prepared by copolymerizing a $C_3$ or $C_4$ monoolefin with at least one alpha-monoolefin having from 5 to 20 carbon atoms, and to a method for lubricating metal surfaces with said compositions.

These and other objects are achieved by formulating oil-containing functional fluids with a major amount of a base oil component and a minor, mist suppressing amount of a copolymer component derived from at least one monoolefin selected from propylene and butene-1 and at one additional alpha-mono olefin having from 5 to 20 carbon atoms. In preferred embodiments of the invention, the mist suppressing copolymer is prepared by copolymerizing butene-1 with at least one other alpha-monoolefin having 5 to 20 carbon atoms. Preferably, the alpha-monoolefins copolymerized with the butene-1 are those having 6 to 14 carbon atoms, with hexene-1, octene-1, decene-1, dodecene-1 and tetradecene-1 being the most preferred comonomers. The copolymer mist suppressing agent that is to be admixed with the base oil component desirably has a viscosity average molecular weight in excess of 100,000, for example, from 100,000 to about 20 million, and generally will comprise about 10 to 90 mole percent $C_3$ or $C_4$ hydrocarbon units and about 90 to 100 mole percent of units derived from other $C_5$–$C_{20}$ alpha-monoolefins.

The copolymer agent is added to the oil-containing functional fluid at a concentration which is effective to produce the desired mist suppression. In preferred embodiments of the invention in which propylene or butene-1 is copolymerized with a $C_6$ to $C_{14}$ alpha-monoolefin, the copolymer mist suppressing agent contains 25 to 75 mole percent $C_3$- or $C_4$-derived hydrocarbon units, is added to the functional fluid composition at a concentration of from about 0.0001 wt. percent (1 ppm) to about 0.04 wt. percent (400 ppm), and has a viscosity average molecular weight in the range of from about 500,000 to about 10 million. Among the more preferred copolymers for use in the invention are those prepared from butene-1 and one or more of hexene-1, octene-1, decene-1, dodecene-1 and tetradecene- 1.

DETAILED DESCRIPTION OF THE INVENTION

Although the invention is applicable to the suppression of misting, also known as spattering, fogging or the like, from a wide variety of oil-containing functional fluids, for the purposes of illustration, the following description has been limited to a discussion of functional fluids which are particularly adapted for single use lubricating applications, such as, for example, the lubrication of chain saw bars.

Surprisingly low levels of mist or spatter are produced during operation of a chain saw when the chain saw lubricating fluid composition comprises a major amount of an oil of lubricating viscosity and a minor amount of a high molecular weight copolymer of propylene or butene-1 and at least one alpha-monolefin having from 5 to about 20 carbon atoms. Typically, the high molecular weight copolymer will be added to the chain saw lubricating fluid at a concentration of about 0.005 to about 0.04 wt. % to achieve the desired low levels of misting.

Generally, highly favorable mist suppression has been observed when the copolymer additives are prepared from alpha-monoolefins having 4 to about 16 carbon atoms. Particularly useful alpha-monoolefins are hexene-1, octene-1, decene-1, dodecene-1 and tetradecene-1. These monomers are preferred for use in the process of the present invention since they are easily polymerized under liquid state polymerization techniques which are well known in the art.

Examples of two monomer component systems are propene-dodecene-1, butene-1-dodecene-1, butene-1 -decene-1, hexene-1-dodecene-1, and octene-1-tetradecene-1, etc. Examples of three component systems include butene-1-decene-l-dodecene-1, propene-hexene-1-dodecene-1, etc. Preferred specific monomeric systems are propene-dodecene-1, butene-1-dodecene-1, butene-1-decene-1, and hexene-1-dodecene-1.

The method of copolymerization of the monomers is not a part of the invention. In general any of the several well known methods for polymerizing alpha-monoolefins can be employed. A particularly suitable method is the Ziegler process using catalyst systems comprising combinations of a compound of a metal of Groups IV-B, V-B, VI-B or VIII of the Periodic Chart of the Elements found on pages 392–393 of the Handbook of Chemistry and Physics, 37th Edition with an organometal compound of a rare earth or metal from Groups I-A, II-A, III-B of the Periodic Chart of the Elements. Particularly suitable catalyst systems are those comprising titanium halides and organoaluminum compounds. A typical polymerization procedure is to contact the monomeric mixture with the catalyst in a suitable inert hydrocarbon solvent for the monomers and the catalyst in a closed reaction vessel at reduced temperatures and autogenous pressure and in a nitrogen atmosphere. Further details of the Ziegler process are set forth in U.S. Pat. No. 3,692,676.

The total $C_3$ or $C_4$ hydrocarbon concentration in the copolymers of the mist suppressing additives of the invention desirably varies from about 90 mole percent to about 10 mole percent. The factor limiting the upper concentration of propylene or butene-1 in the copolymers of the invention is solubility. As the propylene or butene-1 concentration in the copolymers increases, the crystallinity increases and the solubility of the copolymers in hydrocarbons decreases. Decreasing solubility has an adverse effect on the lubricating composition. The solubility limits of copolymers varies, of course, with different copolymer systems. In general, the practical upper propylene or butene-1 content limit for useful copolymers is about 90 mole percent. Copolymer compositions having $C_3$ or $C_4$ concentrations exceeding about 90 mole percent have relatively poor mist suppressing properties. On the other hand the economic advantage of using the less expensive propylene or butene-1 in the preparation of the copolymer compositions is lost if the $C_3$ or $C_4$ hydrocarbon incorporation in the polymer drops below about 10 mole percent. In preferred embodiments of the invention the total $C_3$ or $C_4$ hydrocarbon concentration in the copolymer additive is about 25 to 75 mole percent, and the total concentration of alpha-monoolefin having 5 to 20 carbon atoms is about 75 to 25 mole percent. Those skilled in the art will appreciate the fact that small amounts of the propylene or butene-1 may incorporate into the copolymer composition as homopolymer and that the above-stated $C_3$ or $C_4$ hydrocarbon concentrations refer to the total $C_3$or $C_4$ hydrocarbon content of the copolymer compositions and includes propylene or butene-1 homopolymer and propylene or butene-1 present in copolymer form. On a weight basis, copolymers coming within the scope of the invention are those having about 10 to 90 weight percent propylene or butene-1, and preferably about 25 to 75 weight percent propylene or butene-1. The optimum propylene or butene-1 concentrations will, of course, vary depending on which monomer or monomers are used as the other alpha-monoolefin component.

As noted above, high molecular weight copolymers are used in the compositions of the invention. The only practical limitation on molecular weight is that it must be high enough to produce effective mist suppression without being so high as to present handling difficulties. In this latter regard, it has been found that copolymers of very high molecular weight are difficult to dissolve in the base oil of the lubricating oil compositions. They are also difficult to filter or to pour at low temperatures. The use of very high molecular weight polymers also tends to result in lubricating oil formulations which are relatively unstable. Accordingly, the copolymers useful in this invention are generally limited to those having a viscosity average molecular weight of no more than about 10 million. In general, the viscosity average molecular weight of desirable copolymers is usually over 100,000, and typically is in the range of about 100,000 to about 10 million. The average molecular weight of copolymers used in the invention preferably is in the range of about 500,000 to 10 million, and most preferably is in the range of about 1 to 8 million. In general, the effectiveness of the mist suppression increases as the molecular weight of the copolymer additive increases.

The molecular weight of polymers can be determined by any one of several methods, including light scattering and vapor phase osmometry, gel permeation chromatography (GPC), or the like. Some methods for determining molecular weight provide a weight average molecular weight, while others provide a number average molecular weight or viscosity average molecular weight. For the sake of uniformity the term "average molecular weight", as used in this specification and appended claims, shall mean the viscosity average molecular weight. Typically, the viscosity average molecular weight can be determined by determined by gel permeation chromatography (GPC) conducted at 135° C. using a narrow molecular weight range polystyrene bead calibration standard and ortho-dichlorobenzene as a solvent. Basically, GPC uses the size of the polymer molecules, defined by the hydrodynamic radius, as a means for determining the molecular weight. The technique involves passing a solution of the polymer through a bed of cross-linked polymer. Smaller molecules can diffuse into the pores of the cross-linked polymer bed such that their travel through the bed is delayed compared to larger molecules which pass by the pores and continue in the solvent phase. For more information concerning GPC, see W. W. Yau et al, Modern Size-Exclusion Liquid Chromatography, Wiley-Interscience (1979), and Waters Associates Liquid Chromatography Solvent Manual, Waters Associates (Millipore Corp.)(1983).

The amount of copolymer additive required to be added to the chain saw lubricating oil compositions of this invention, to produce the desired mist suppressing result (expressed as weight percent, i.e. parts by weight of copolymer per 100 parts by weight of the fully formulated lubricating oil composition, including the copolymer) will vary depending on the physical properties and formulation of the lubricating oil composition. With some formulations, the desired result may be obtained by the addition of 0.0001 wt. % or less of the copolymer to the lubricating composition. On the other hand, some lubricating compositions may require as much as 1.0 wt. % or more of copolymer addition to produce the desired result. However, it has been found that the desired result typically is obtained by the addition from about 0.005 to about 0.5 wt. % of the copolymer to the chain saw lubricating composition. In preferred embodiments, the copolymer is added to the lubricating composition in amounts of from about 0.005 to about 0.04 wt. %.

Since the copolymer is a solid at the stated molecular weight it is usually preferred to dissolve it in a suitable solvent or suspend it in a suitable diluent prior to use since it is easier to add to the lubricating composition in the form of a solution or a slurry. Suitable solvents and diluents include kerosene, naphtha and other petroleum distillates and inert hydrocarbons such as hexane, heptane, octane or the like.

The lubricating base oil to which the mist suppressing copolymers are added to form the lubricating oil compositions of the present invention can be a mineral oil or a synthetic hydrocarbon oil of lubricating viscosity, typically having a viscosity of from about 70 to about 300 Saybolt Universal Seconds (SUS) at 100° F. While the oil may be paraffinic, naphthenic, or mixed base, it is preferred that the base oil be substantially non-polar and that it be substantially inert. As used in this specification and appended claims, the term "substantially non-polar" is intended to mean that the base oil may contain no more than about 0.5 wt. % of oxygen, nitrogen and/or sulfur; and the term "substantially inert" is intended to mean that the material being described is inert to chemical or physical change under the conditions in which it is used so as not to materially interfere in an adverse manner with the preparation, storage, blending and/or functioning of the compositions, additives, compounds, etc., of this invention in the context of its intended use. For example, small amounts of base oil, or a solvent, diluent, etc., can undergo minimal reaction or degradation without preventing the making and using of the invention as described herein. In other words, such reaction or degradation, while technically discernible, would not be sufficient to deter the practical worker of ordinary skill in the art from making and using the invention for its intended purposes. "Substantially non-polar" and "substantially inert" as used herein are, thus, readily understood and appreciated by those of ordinary skill in the art.

The base oils suitable for use in preparing compositions of the present invention include those conventionally employed in single use lubricating oil formulations.

Representative examples of liquids suitable for use as the base oil include mineral and synthetic oils, e.g., the solvent neutrals, white oils, naphthenic oils, etc., the linear and branched alkanes and haloalkanes of six to eighteen carbons, polyhalo- and perhaloalkanes of up to about six carbons, the cycloalkanes of five or more carbons, the corresponding alkyl-and/or halo-substituted cycloalkanes, the aryl hydrocarbons, the lower alkylaryl hydrocarbons, and the haloaryl hydrocarbons.

Specific examples include Stoddard Solvent, hexane, decane, isooctane, undecane, tetradecane, cyclopentane, cyclohexane, isopropylcyclohexane, 1,4-dimethylcyclohexane, cyclooctane, benzene, toluene, xylene, ethyl benzene, tert-butylbenzene, halogenzenes especially mono- and polychlorogenzenes such as chlorobenzene per se and 3,4-dichlorotoluene, 1,2-difluorotetrachloroethane, dichlorofluoromethane, 1,2-dibromotetrafluoroethane, trichlorofluoromethane, 1-chloropentane, and 1,3-dichlorohexane.

Also useful as base oils are the low molecular weight, liquid polymers, generally classified as oligomers, which include the dimers, tetramers, pentamers, etc. Illustrative of this large class of materials are such liquids as the propylene tetramers, isobutylene dimers, and the like.

Mineral oils are preferred. Suitable mineral lubricating oils vary widely as to their crude source, e.g., whether paraffinic, naphthenic, mixed paraffinic-naphthenic, and the like; as well as to their formation, e.g., distillation range, straight run or cracked, hydrofined, solvent extracted and the like.

More specifically, the natural lubricating oil base stocks which can be used in the compositions of this invention may be liquid petroleum oils, straight mineral lubricating oil, solvent treated, acid treated or distillates derived from paraffinic, naphthenic, asphaltic, or mixed base crudes; or, if desired, various blended oils may be employed as well as residuals, particularly those from which asphaltic constituents have been removed. Oils of appropriate viscosity derived from coal or shale are also useful base oils.

Synthetic base oils include hydrocarbon oils, such as polymerized and interpolymerized olefins [e.g., polybutylenes, polypropylenes, propylene-isobutylene copolymers, poly(1-hexenes), poly(1-octenes), poly(1-decenes)]; alkybenzenes [e.g., dodecylbenzenes, tetradecyl benzenes, dinonylbenzens, di(2-ethlhexyl)benzenes]; polyphenyls [e.g., biphenyls, terphenyls, alkylated polyphenyls]; and the substantially non-polar derivatives, analogs and homologs thereof.

Unrefined, refined and rerefined oils can be used as the base oil according to the present invention. Unrefined oils are those obtained directly from a mineral or synthetic source without further purification treatment. For example, a shale oil obtained directly retorting operations, a petroleum oil obtained directly form distillation and used without further treatment would be an unrefined oil. Syncrude obtained from tar sands is another example of unrefined oil. Refined oils are similar to the unrefined oils except they have been further treated in one or more purification steps to improve one or more properties. Many such purification techniques, such as distillation, solvent extraction, hydrotreating acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

The preferred base oils include the linear and branched $C_6$–$C_{18}$ alkanes, mineral oil and refined petroleum oils.

The chain saw lubricating oil compositions of the present invention may comprise only the base oil and the mist suppressing copolymer additive and may be formulated simply by blending together the base oil and the mist suppressing additive. However, it is contemplated that other additives may be combined with the base oil and mist suppressor copolymer additives to provide additional properties which enhance the desirability of the present compositions. Other conventional additives which may be included in the chain saw compositions of this invention include, for example, rust inhibitors, anti-oxidants, pour point depressants, anti-wear additives, anti-foam additives and the like.

Rust inhibitors that may be added to the present chain saw lubricating compositions include, for example, basic nitrogen compounds such as dicarboxylic acid amides and fatty acid amides; imidazolines; and phosphoric acid derivatives, such as dialkyl- or diaryldithiophosphate salts. Still other suitable rust inhibiting agents include alkyl phenols; sulfurized alkyl phenols; alkyl salicylates, alkenyl succinic anhydrides and other oil soluble mono- and dicarboxylic acids; mixtures derived from the reaction product of fatty acids (e.g., $C_8$–$C_{22}$), boric acid and hydroxy amines, e.g., diethanolamine which contain borated fatty amides and borate hydroxy amine esters; borate esters of hydroxy alkyl amines such as diethanolamine (See, U.S. Pat. No. 3,642,652); aryl sulfonamide carboxylic acids, their amine salts and mixtures of the same with borated esters of diethanolamine (See, U.S. Pat. No. 4,297,236); and divalent metal or amine salts of sulfonic acid, polybasic acids (e.g., tall oil fatty acids) and alkanolamides (See, U.S. Pat. No. 4,395,286). The above identified patents are incorporated herein for their disclosure of rust inhibiting and anti-rust agents.

Oxidation inhibitors, or anti-oxidants, reduce the tendency of mineral oils to deteriorate in service which deterioration can be evidenced by the products of oxidation such as sludge and gum-like deposits on the chain saw links, bar or other metal surfaces being lubricated. Such oxidation inhibitors include alkaline earth metal salts of alkylphenolthioesters having preferably $C_5$ to $C_{12}$ alkyl side chains, e.g., calcium nonylphenol sulfide and barium octylphenyl sulfide; aromatic amines, e.g., dioctylphenylamine and phenylalpha-naphthylamine; phosphosulfurized or sulfurized hydrocarbons; and hindered phenols, such as butylated hydroxy toluene.

Pour point depressants otherwise known as lube oil flow improvers, lower the temperature at which the fluid will flow or can be poured. Such additives are well known. Typically of those additives which usefully optimize the low temperature fluidity of a functional fluid are $C_8$–$C_{18}$ dialkylfumarate vinyl acetate copolymers, polymethacrylates, alkylated polystyrene, and wax naphthalene.

Anti-wear additives, which would be useful in certain applications to prevent scuffing of moving parts of the chain saw, include, for example, metal dithiocarbamates; molybdenum disulfide; chlorinated hydrocarbons; organic phosphates, such as tricresyl phosphate, and zinc salts of dialkyl- and diaryldithiophosphoric acids. Such zinc salts also function as an oxidation inhibitor and to prevent copper corrosion.

Friction modifiers serve to impart the proper friction characteristics to lubricating oil compositions such as chain saw oils.

Representative examples of suitable friction modifiers are found in U.S. Pat. No. 3,933,659 which discloses fatty acid esters and amides; U.S. Pat. No. 4,176,074 which describes molybdenum complexes of polyisobutyenyl succinic anhydride-amino alkanols; U.S. Pat. No. 4,105,571 which discloses glycerol esters of dimerized fatty acids; U.S. Pat. No. 3,779,928 which discloses alkane phosphoric acid salts; U.S. Pat. No. 3,778,375 which discloses reaction products of a phosphorate with an oleamide; U.S. Pat. No. 3,852,205 which discloses S-carboxyalklene hydrocarbyl succinimide, S-carboxyalkylene hydrocarbyl succinamic acid and mixtures thereof; U.S. Pat. No. 3,879,306 which discloses N-(hydroxyalkylene)alkenylsuccinamic acids or succinimides; U.S. Pat. No. 3,932,290 which discloses reaction products of di-(lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are succinate esters, or metal salts thereof, of hydrocarbyl substituted succinic acids or anhydrides and thiobis-alkanols such as described in U.S. Pat. No. 4,344,853.

Foam control can be provided by an anti-foam additive of the polysiloxane type, e.g., silicone oil and polydimethyl siloxane.

Some of these numerous additives can provide a multiplicity of effects, e.g., a dispersant-oxidation inhibitor. This approach is well known and need not be further elaborated herein.

Compositions when containing these conventional additives are typically blended into the base oil in amounts which are effective to provide their normal attendant function. Representative effective amounts of the above classes of additives in the chain saw lubricating oil formulations of this invention are summarized below:

| Additive Type | Wt. % Broad | Wt. % Preferred |
|---|---|---|
| Copolymer mist suppressor | 0.0001–1.0 | 0.005–0.04 |
| Rust Inhibitor | 0.03–3 | 0.05–0.5 |
| Anti-oxidant | 0.05–3 | 0.1–1.0 |
| Pour point depressant | 0.03–3 | 0.05–0.2 |
| Anti-wear additive | 0.03–3 | 0.05–0.4 |

-continued

| Additive Type | Wt. % Broad | Wt. % Preferred |
|---|---|---|
| Friction modifiers | 0–3 | 0.05–0.2 |
| Anti-foam | 0.001–0.05 | 0.005–.01 |

The chain saw lubricating oil compositions may be prepared simply by blending together the various components. Typically all of the minor components will be added to the base oil; they may be added neat, or as concentrates in oil and/or solvent solutions, where the oil and/or solvent is compatible with the base oil. The components may all be blended simultaneously or, if desired, one or more of the components may be blended separately and the mixtures then further blended with the remaining components to form the final compositions.

The following examples are given as specific illustrations of the claimed invention. It should be understood, however, that the invention is not limited to the specific details set forth in the examples. All parts and percentages in the examples as well as in the remainder of the specification are by weight unless otherwise specified.

EXAMPLE 1

A series of binary polymer/solvent mixtures (Formulations 1–7) were prepared by blending together a heptane carrier solvent and a mist suppressing butene-1-dodecene-1 copolymer (10% copolymer active ingredient dissolved in kerosene). The butene-1-dodecene-1 copolymer was a commercial product available from Baker Performance Chemicals, Houston, Tex., under the tradename Flo® 1003 pipeline booster. The copolymer is a white opaque viscous liquid having a flash point of 125° F., a boiling point of 350° F., and a specific gravity of 0.79. The viscosity average molecular weight of the copolymer is approximately 4.4 million. The composition of Formulations 1–7 is summarized in Table 1.

EXAMPLE 2C

The procedure of Example 1 was followed, except that the butene-1-dodecene-1 copolymer mist suppressor was replaced with a commercial polyisobutyene polymer mist suppressor. The polyisobutylene polymer was a commercial product of Exxon Chemical Co., Houston Tex., and is available under the tradename Vistanex TM MM L-140. The polymer had a viscosity average molecular weight of 2.11 million and is believed to be the highest molecular weight grade polyisobutylene produced commercially in the United States. The polymer was added neat to the heptane carrier solvent to form Formulations 8C-13C, the composition of which is summarized in Table 1.

EXAMPLE 3C

Comparative Formulation 14C was prepared comprising only heptane with no mist suppressing additive.

The composition of Formulations 1–7 and 8C-14C is summarized in Table 1 as follows:

TABLE 1

| Formulation No. | Mist Suppressor identity | Additive wt. % | Solvent wt. % |
|---|---|---|---|
| 1 | Butene-1-dodecene-1 copolymer | 0.005 | 99.995[1] |
| 2 | Butene-1-dodecene-1 copolymer | 0.01 | 99.99[1] |

TABLE 1-continued

| Formulation No. | Mist Suppressor identity | Additive wt. % | Solvent wt. % |
|---|---|---|---|
| 3 | Butene-1-dodecene-1 copolymer | 0.03 | 99.97[1] |
| 4 | Butene-1-dodecene-1 copolymer | 0.05 | 99.95[1] |
| 5 | Butene-1-dodecene-1 copolymer | 0.1 | 99.9[1] |
| 6 | Butene-1-dodecene-1 copolymer | 0.2 | 99.8[1] |
| 7 | Butene-1-dodecene-1 copolymer | 0.5 | 99.5[1] |
| 8C | Polyisobutylene | 0.015 | 99.985 |
| 9C | Polyisobutylene | 0.023 | 99.977 |
| 10C | Polyisobutylene | 0.046 | 99.954 |
| 11C | Polyisobutylene | 0.138 | 99.862 |
| 12C | Polyisobutylene | 0.23 | 99.77 |
| 13C | Polyisobutylene | 0.46 | 99.54 |
| 14C | none | 0 | 100 |

[1]includes heptane carrier solvent and kerosene (mist suppressor additive diluent)

The anti-mist properties imparted to a fluid by the addition thereto of a high molecular weight polymer can be observed by several techniques. One simple technique, which provides a qualitative measure of the anti-mist properties is the Atomizer Spray Technique. For this procedure an atomizer spray bottle equipped with a pump to pressurize the contents of the bottle is employed. One suitable bottle for use in this procedure, identified as the Airspray TM spray bottle, can be obtained from Consolidated Plastics Co., Twinsburg, Ohio. Such atomizer spray bottles typically are equipped with a series of replaceable outlet tips or nozzles which control the pattern of the spray that is ejected therefrom. The Airspray TM spray bottle, for example, comes equipped with three standard nozzles which are designed to eject an unthickened material (such as water) from the bottle in a heavy mist pattern, a fine mist pattern, or a Jet stream pattern, respectively.

In order to demonstrate the effectiveness of copolymer mist suppressing additive of the present invention, a sample of Formulation 14C (heptane control sample) was charged to the sprayer which was equipped with the standard nozzle designed for expelling the contents of the bottle as a heavy mist. The sprayer was then pumped to pressurize the heptane sample to a recorded level sufficient to eject the heptane sample from the bottle as a heavy mist.

The above procedure was then repeated (washing the sprayer after each use) using samples of Formulations 1-7 and 8C-13C. For each sample tested, using the same nozzle that was used to spray the control sample (Formation 14C), the spray pattern was usually compared to the spray pattern of the control sample. It was observed that the samples of Formulations 1, 2, 8C-11C, and 14C were ejected from the bottle as a heavy mist, whereas the samples of Formulations 3-5, 12C and 13C were ejected as a jet stream. Formulation 6 resulted in only a very slight and halting flow, whereas Formulation 7 did not flow at all from the bottle.

The results of the Atomizer Spray Technique evaluation are set forth in Table 2.

TABLE 2

| | Atomizer Spray Technique | | |
|---|---|---|---|
| Formulation | Mist Suppressor identity | Additive, wt. % | Type of Spray |
| 1 | Butene-1-dodecene-1 copolymer | 0.005 | mist |
| 2 | Butene-1-dodecene-1 copolymer | 0.01 | mist |
| 3 | Butene-1-dodecene-1 copolymer | 0.03 | jet stream |
| 4 | Butene-1-dodecene-1 copolymer | 0.05 | jet stream |
| 5 | Butene-1-dodecene-1 copolymer | 0.1 | jet stream |
| 6 | Butene-1-dodecene-1 copolymer | 0.2 | slight halting flow |
| 7 | Butene-1-dodecene-1 copolymer | 0.5 | no flow |
| 8C | polyisobutylene | 0.015 | mist |
| 9C | polyisobutylene | 0.023 | mist |
| 10C | polyisobutylene | 0.046 | mist |
| 11C | polyisobtylene | 0.138 | mist |
| 12C | polyisobtylene | 0.23 | jet stream |
| 13C | polyisobtylene | 0.46 | jet stream |
| 14C | none | 0 | mist |

Table 2 illustrates that butene-1-dodecene-1 copolymer was effective to suppress misting and to convert the fluid ejected from the spray bottle from a mist to a Jet stream at a concentration level at least as low as 0.03 wt. %. By comparison the commercially available polyisobutylene additive was not effective to suppress misting until it was added to the heptane carrier fluid at a concentration level of 0.23 wt. %. Accordingly, based on the results of the atomizer spray test procedure, the use of butene-1-dodecene-1 copolymer as the mist suppressing additive was more than 7 times as effective as the use of the polyisobutylene additive.

An alternative method for evaluating and predicting the anti-mist properties imparted by polymeric mist suppressor additives is to measure the extensional viscosity of a solution of the various additives. However, unlike shear viscosity, extensional viscosity is difficult to measure because liquid cannot be grabbed and stretched at a constant velocity. One method of measuring extensional viscosity of polymer solutions is outlined in Exxon Research And Engineering Company's Analytical Method Specification (AM-S) 89-006 (December 1990). This procedure is employed to determine the break height (h) of a so-called "tubeless siphon" of a dilute polymer solution, as well as the "specific tackiness" (h/c) of the polymer, where h is a height measured in cm. and c is the concentration of the polymer, in mass percent, in a NORPAR® 15 solution (a $C_{15}$ liquid paraffin). The height (h) in centimeters is defined as being the height to which a thin flowing strand of the polymer solution can be pulled (without breaking) from a container holding the polymer solution by touching a 3.8 cm long×20 gauge syringe (flat tip) needle (0.023 in. I.D.) (connected to a vacuum pump) to the surface of the solution, while maintaining a partial vacuum (about −40 kPa) above the polymer solution (at a temperature of about 25° C.), and moving the needle relative to the surface of the polymer solution at 5 mm/second (+/−1 mm/sec.) (e.g., by lowering the container while keeping the needle point fixed, or by raising the needle above the polymer solution surface in the container) to siphon the polymer solution. A measure is taken of the distance separating the surface of the solution in the container and the needle point when the siphon breaks, and this distance, in centimeters, is h. Thus, the higher the value of h, i.e., the longer the tubeless siphon liquid column at the break point, the greater the stringiness of the fluid.

The specific tackiness (h/c) of the polymer in solution is suggestive of the anti-mist properties of the polymer, i.e., the greater the specific tackiness, the better are expected to be the anti-mist properties of the fluids in which the polymer is dissolved. The vacuum used should be sufficient to maintain a substantially constant velocity of fluid flow through the needle. Generally, a vacuum of about −40 kPa will be employed. For more information, see K. K. K. Chao and M. C. Williams, J. Rheology, 27 (5) 451–474 (1983).

EXAMPLE 4

A series of sample formulations (Formulations 15–18, 19C and 20C) were prepared by dissolving varying concentrations of either butene-1-dodecene-1 copolymer (10 wt. % a.i. in kerosene) or high molecular weight polyisobutylene (5 wt. % a.i. in paraffinic oil) in NORPARR ®15 carrier oil. Each of the samples was tested for its specific tackiness in accordance with Exxon Research And Engineering Company's Analytical Method Specification (AM-S) 89-006 (December 1990), as outline above. The composition and the specific tackiness of each formulation are summarized in Table 3.

TABLE 3

| Formulation | Dissolved Polymer in Test Oil[1] Identity | wt. % | ppm | h.cm. | h/c.cm/m. % |
|---|---|---|---|---|---|
| 15 | butene-1-dodecene-1 copolymer[2] | 0.025 | 250 | 0 | balling[4] |
| 16 | butene-1-dodecene-1 copolymer[2] | 0.00625 | 62.5 | 0 | balling[4] |
| 17 | butene-1-dodecene-1 copolymer[2] | 0.00156 | 15.6 | 5.34 | 3420 |
| 18 | butene-1-dodecene-1 copolymer[2] | 0.000391 | 3.9 | 1.22 | 3120 |
| 19C | Polyisobutylene[3] | 1.0 | 10000 | 5.9 | 5.9 |
| 20C | Polyisobutylene[3] | 0.5 | 5000 | 2.5 | 5.0 |

[1]Carrier oil = $C_{15}$ paraffin oil (NORPAR ® 15).
[2]Flo ® 1003 pipeline booster of Example 1.
[3]polyisobutylene of Example 2C (Vistanex ™ MM L-140).
[4]polymer solution acted as semi-solid at needle tip and did not enter needle.

Table 3 illustrates that butene-1-dodecene-1 copolymer is an effective tackifier agent for a mineral oil carrier, even as very low concentration levels. Thus, the use of as little as 15.6 ppm of butene-1-dodecene-1 copolymer resulted in a polymer solution break height comparable to that observed when using 10,000 ppm of high molecular weight polyisobutylene as the tackifier resin.

EXAMPLE 5

A series of chain saw lubricating oil formulations (Formulations 21–26) was prepared by blending varying amounts of the butene-1-dodecene-1 copolymer mist suppressing agent of Example 1 with a lubricating oil basestock, an anti-oxidant additive and an anti-rust additive. Several comparative formulations were prepared in which no mist suppressive resin was added (Formulation 27C), or in which the butene-1-dodecene-1 copolymer additive (10 wt. % a.i. in kerosene) was replaced either by the polyisobutylene polymer (5 wt. % a.i. in paraffin oil) of Example 2C (Formulations 28C and 29C) or by a commercial polymeric tackifier solution which is believed to be an ethylene-propylene copolymer (5 wt. % a.i. in mineral oil basestock) having a viscosity average molecular weight of about 250,000 (Formulations 30C and 31C). Comparative Formulation 32C was prepared comprising only the lubricating oil basestock with no mist suppressing additive, no anti-oxidant additive and no anti-rust additive.

The viscosity at room temperature for each formulation was measured. Each formulation was also tested in accordance with Exxon Research And Engineering Company's Analytical Method Specification (AM-S) 89–006 (December, 1990), and the break height (h) of each formulation was measured.

The composition of Formulations 21–26 and 27C-32C and the test results are summarized in Tables 4, 5 and 6 as follows:

TABLE 4

| Component, wt. % | Formulation No. 21 | 22 | 23 | 24 | 25 | 26 |
|---|---|---|---|---|---|---|
| butene-1-dodecene-1[1] | 0.025 | 0.05 | 0.10 | 0.10 | 0.15 | 0.30 |
| polyisobutylene | — | — | — | — | — | — |
| ethylene-propylene | — | — | — | — | — | — |
| anti-oxidant[2] | 0.4 | 0.4 | 0.4 | — | 0.4 | 0.4 |
| anti-rust[3] | 0.04 | 0.04 | 0.04 | — | 0.04 | 0.04 |
| basestock[4] | 99.535 | 99.51 | 99.46 | 99.90 | 99.41 | 99.26 |

[1]includes kerosene diluent
[2]butylated hydroxy toluene
[3]half ester of alkenylsuccinic acid (PARABAR ® 302-a product of Exxon Chemical Company, Bayway, New Jersey).
[4]Exxon 105 Pale Paraffin basestock (105 Saybolt second kinematic viscosity at 40° C.

TABLE 5

| Component, wt. % | Formulation No. 27C | 28C | 29C | 30C | 31C | 32C |
|---|---|---|---|---|---|---|
| butene-1-dodecene-1 | — | — | — | — | — | — |
| polyisobutylene | — | 0.5 | 1.0 | — | — | — |
| ethylene-propylene | — | — | — | 0.5 | 1.0 | — |
| anti-oxidant[1] | 0.4 | 0.4 | 0.4 | 0.4 | 0.4 | — |
| anti-rust[2] | 0.04 | 0.04 | 0.04 | 0.04 | 0.04 | — |
| basestock[3] | 99.56 | 99.06 | 98.56 | 99.06 | 98.56 | 100.00 |

[1]butylated hydroxy toluene
[2]half ester of alkenylsuccinic acid (PARABAR ® 302)
[3]Exxon 105 Pale Paraffin basestock (105 Saybolt second kinematic viscosity at 40° C.

TABLE 6

| Formulation No. | Viscosity cSt | h.cm. |
|---|---|---|
| 21 | — | 0.78 |
| 22 | — | 1.28 |
| 23 | — | 2.24 |
| 24 | — | 5.58 |
| 25 | 43.40 | 2.96 |
| 26 | 47.30 | 9.60 |
| 27C | 42.00 | 0 |
| 28C | 46.50 | 1.80 |
| 29C | 46.50 | 3.44 |
| 30C | 42.90 | 0.92 |
| 31C | 44.40 | 1.42 |

TABLE 6-continued

| Formulation No. | Viscosity cSt | h.cm. |
|---|---|---|
| 32C | 41.00 | 0 |

The data in Tables 4–6 illustrates that chain saw lubricating oil formulations containing as little as 0.025 wt. % of butene-1-dodecene-1 copolymer mist suppressor additive are characterized by a measurable break height in the test procedure for determining a polymer solution's specific tackiness. The data also illustrates that the measured break height when using butene-1-dodecene-1 copolymer as the mist suppressor is comparable to the break height recorded for formulations using five times as much polyisobutylene or ethylene-propylene copolymer in place of the butene-1-dodecene-1 copolymer. The data also illustrates that formulations which contained no mist suppressor additive did not produce any measurable break height.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. In a process for suppressing mist formation from a single use lubricating oil, the improvement which comprises:

admixing with the lubricating oil from about 0.0001 to 0.04 weight percent of a copolymer prepared by copolymerizing at least one alpha-monoolefin selected from propylene and butene-1 with at least one additional alpha-monoolefin having from 5 to about 20 carbon atoms, said copolymer having a viscosity average molecular weight of from about 100,000 to about 20 million.

2. The process of claim 1, wherein said copolymer is prepared by copolymerizing butene-1 with at least one additional alpha-monoolefin having from 6 to 14 carbon atoms.

3. The process of claim 2, wherein said additional monoolefin is selected from the group consisting of hexene-1, octene-1, decene-1, dodecene-1, tetradecene-1 and mixtures thereof.

4. The process of claim 3, wherein said additional monoolefin is dodecene-1.

5. The process of claim 1, wherein said copolymer comprises from about 10 to about 90 mole percent $C_3$ or $C_4$ monoolefin-derived units and from about 90 to about 10 mole percent of units derived from $C_5$–$C_{20}$ monoolefin.

6. The process of claim 5, wherein said copolymer comprises from about 25 to about 75 mole percent $C_3$ or $C_4$ monoolefin-derived units and from about 75 to about 25 mole percent of units derived from $C_5$–$C_{20}$ monoolefin.

7. The process of claim 1, wherein said copolymer comprises from about 10 to about 90 mole percent butene-1-derived units and from about 90 to about 10 mole percent of units derived from $C_6$ to $C_{14}$ monoolefin.

8. The process of claim 7, wherein said butene-1-derived units comprise from about 25 to about 75 mole percent of said copolymer.

9. The process of anyone of claims 1 to 8 wherein said copolymer has a viscosity average molecular weight of from about 500,000 to about 10 million.

10. In a process for lubricating a chain saw with an oil of lubricating viscosity, the improvement which comprises:

admixing with the oil of lubricating viscosity from about 0.0001 to 0.04 weight percent of a copolymer prepared by copolymerizing at least one alpha-monoolefin selected from propylene and butene-1 with at least one additional alpha-monoolefin having from 5 to about 20 carbon atoms, said copolymer having a viscosity average molecular weight of from about 100,000 to about 20 million.

11. A single use lubricating oil which comprises:

(a) a major amount of an oil lubricating viscosity, and (b) from about 0.0001 to 0.04 weight percent of a copolymer prepared by copolymerizing at least one alpha-monoolefin selected from propylene and butene-1 with at least one additional alpha-monoolefin having from 5 to about 20 carbon atoms, said copolymer having a viscosity average molecular weight of from about 100,000 to about 20 million.

12. The oil of claim 11, wherein said copolymer is prepared by copolymerizing butene-1 with at least one additional alpha-monoolefin having from 6 to 14 carbon atoms.

13. The oil of claim 12, wherein said additional monoolefin is selected from the group consisting of hexene-1, octene-1, decene-1, dodecene-1, tetradecene-1, and mixtures thereof.

14. The oil of claim 13, wherein said additional monoolefin is dodecene-1.

15. The oil of claim 11, wherein said copolymer comprises from about 10 to about 90 mole percent $C_3$ or $C_4$ monoolefin-derived units and from about 90 to about 10 mole percent of units derived from $C_5$–$C_{20}$ monoolefin.

16. The oil of claim 15, wherein said copolymer comprises from about 25 to about 75 mole percent $C_3$ or $C_4$ monoolefin-derived units and from about 75 to about 25 mole percent of units derived from $C_5$–$C_{20}$ monoolefin.

17. The oil of claim 11, wherein said copolymer comprises from about 10 to about 90 mole percent butene-1-derived units and from about 90 to about 10 mole percent of units derived from $C_6$ to $C_{14}$ monolefin.

18. The oil of claim 17, wherein said butene-1-derived units comprise from about 25 to about 75 mole percent of said copolymer.

19. The oil of claim 11, which further contains an effective amount of at least one additional additive selected from the group consisting of (i) rust inhibitors, (ii) anti-oxidants, (iii) pour point depressants, and (iv) anti-wear agents.

20. The oil of claim 19, wherein the oil contains from about 0.005 to about 0.04 weight percent of the copolymer.

* * * * *